US006167813B1

(12) United States Patent
Kaufhold et al.

(10) Patent No.: US 6,167,813 B1
(45) Date of Patent: Jan. 2, 2001

(54) TAPERED WEAR LINER AND ARTICULATED CONNECTOR WITH TAPERED WEAR LINER

(75) Inventors: Horst T. Kaufhold; John J. Steffen, both of Aurora, IL (US)

(73) Assignee: AMSTED Industries Incorporated, Chicago, IL (US)

( * ) Notice: Under 35 U.S.C. 154(b), the term of this patent shall be extended for 0 days.

(21) Appl. No.: 09/152,545

(22) Filed: Sep. 14, 1998

(51) Int. Cl.[7] ..... B61C 1/02
(52) U.S. Cl. ..... 105/3; 105/4.1; 213/75 R
(58) Field of Search ..... 213/75 R, 188; 105/3, 4.1; 384/208, 145; 464/171, 176

(56) References Cited

U.S. PATENT DOCUMENTS

| | | | | |
|---|---|---|---|---|
| 3,216,370 | | 11/1965 | Kulieke | 105/4 |
| 3,236,573 | * | 2/1966 | Donnellan . | |
| 3,396,673 | | 8/1968 | Livelsberger et al. | 105/4 |
| 3,646,604 | | 2/1972 | Tack et al. | 105/4 R |
| 3,716,146 | * | 2/1973 | Altherr | 213/75 R |
| 4,258,628 | | 3/1981 | Altherr | 105/4 R |
| 4,336,758 | * | 6/1982 | Radwill | 105/4 R |
| 5,014,626 | | 5/1991 | Schultz | 105/4.1 |
| 5,560,503 | * | 10/1996 | Daugherty, Jr. | 213/75 R |

* cited by examiner

*Primary Examiner*—S. Joseph Morano
*Assistant Examiner*—Frantz Jules
(74) *Attorney, Agent, or Firm*—Edward J. Brosius; F. S. Gregorczyk; Stephen J. Manich

(57) ABSTRACT

A tapered wear liner and articulated connector using such a tapered wear liner are disclosed. The tapered wear liner supports an annular bearing that supports the male connecting member of the articulated connector. The tapered wear liner has an outer surface that may be shaped as the frustum of a cone or the frustum of a sphere. The female connecting member has a complementary shaped groove to receive the tapered wear liner. The female connecting member has a bottom wall with a substantially uniform thickness from the wear liner to the exterior surface of the female connecting member. A main pin connects the male and female connecting members together and a center pin is integral with the main pin and connected to the railroad car truck. The present invention is useful with railroad car trucks that have concave curved center plate areas.

21 Claims, 2 Drawing Sheets

TAPERED WEAR LINER AND ARTICULATED CONNECTOR WITH TAPERED WEAR LINER

BACKGROUND OF THE INVENTION

1. Field of the Invention

The present invention relates to articulated connectors for connecting railroad cars into semi-permanent units and more particularly to such an articulated connector that has a wear liner and that may be used with railroad car trucks that have spherical center plates.

2. Description of the Prior Art

Use of standard AAR (Association of American Railroads) couplers to connect railroad cars is well known. Such couplers are designed to facilitate the connecting or disconnecting of individual railroad cars to allow such cars to be assembled into a train and uncoupled for remote loading or unloading. The Type-E and Type-F couplers are in common use today.

In recent times, the railroad industry has found that connecting several cars into a semi-permanent unit is advantageous. For example, railroad cars particularly adapted for piggyback service may be so connected. In this arrangement, an articulated connector is used. Articulated connectors generally comprise a male connecting member connected to the sill of one car and a female connecting member connected to the sill of an adjacent car. The male and female connecting members are then connected through a main pin that allows the two connecting members to articulate. The articulated connector may in turn be carried by a single railroad car truck. A center pin extends from the articulated connector to the truck.

Articulated connectors are disclosed in U.S. Pat. Nos. 3,216,370; 3,396,673; 3,646,604; 3,716,146; 4,258,628; and 4,336,758, for example. All of these connectors are for use with railroad car trucks that have flat center plates, and all of these connectors provide mating flat center plates or bosses.

In some areas of the world, standard coupler devices are used with railroad car trucks that have spherical center plate areas. Articulated connectors of the types shown in U.S. Pat. Nos. 3,216,370; 3,396,673; 3,646,604; 3,716,146; 4,258,628; and 4,336,758 cannot be used with the spherical center plate trucks. Instead, an articulated connector with a spherical center plate is necessary.

In addition, in known articulated connectors, the outer end of the male connecting member is supported within the female connecting member on a bearing ring. In such known articulated connectors, a boss extends down from the female connecting member and has a flat center plate. The bearing ring is supported on a wear liner within the female connecting member. Standard wear liners are illustrated in U.S. Pat. No. 5,014,626 (1991) to Schultz, and are annular and each side is generally triangular in cross-section, as shown in FIG. 4 of that patent. Such wear liners are replaceable and are beneficial in reducing wear on the female connecting member.

Provision of an articulated connector with a spherical center plate and a wear liner is problematic since the elevation of the connector from the rail surface must meet existing standards for the articulated connector to have utility and since the walls of the female connecting member must have a sufficient thickness to provide adequate structural strength.

SUMMARY OF THE INVENTION

The present invention provides an articulated connector that can be used with standard railroad car trucks with concave curved center plates, at standard elevations from the rail surfaces, and that includes a tapered wear liner supported by a wall of adequate strength. The present invention also provides a tapered wear liner and a female connecting member suitable for use in such an environment.

DETAILED DESCRIPTION

Figure 1:
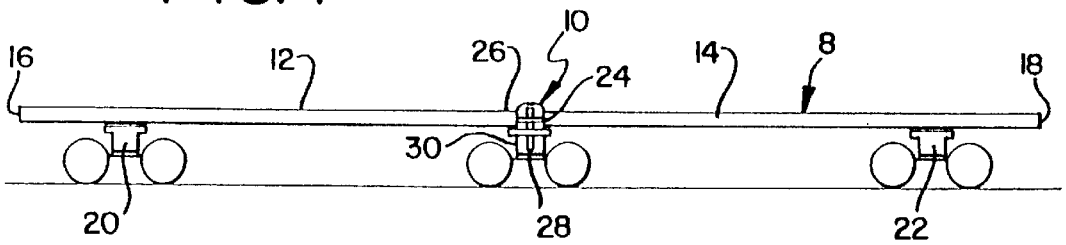
FIG. 1 is a simplified view of two railroad cars being connected by an articulated connector and supported by a single truck therebelow to form a single unit.

As seen in FIG. 1, in a freight train 8 using an articulated connector 10, a first and second railroad car 12, 14 each has its outer ends 16, 18 supported by conventional car trucks 20, 22 in a known manner. Inner adjacent front and rear ends 24, 26 of the railroad cars 12, 14 are connected by an articulated connector 10 which in turn is carried or supported on a bolster 28 of a single railroad car truck 30. It should be understood that more than two railroad cars may be connected to form a unit. In the simplified example of FIG. 1, the unit simply comprises the first and second railroad cars 12, 14, connected by the articulated connector 10 and carried on the three railroad car trucks 20, 22 and 30.

Figure 2:
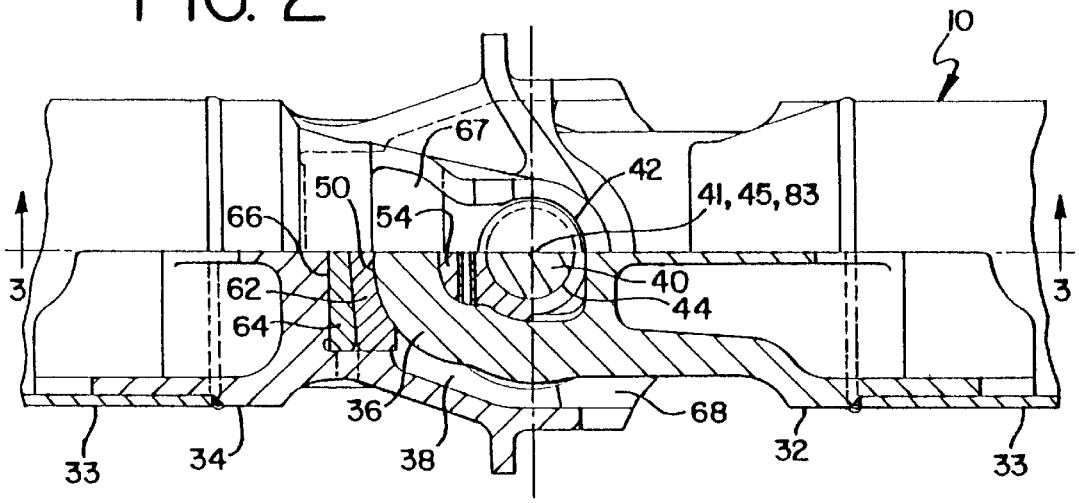
FIG. 2 is a top plan view of an articulated connector incorporating the principles of the present invention, with the lower half shown in cross-section.
Figure 3:
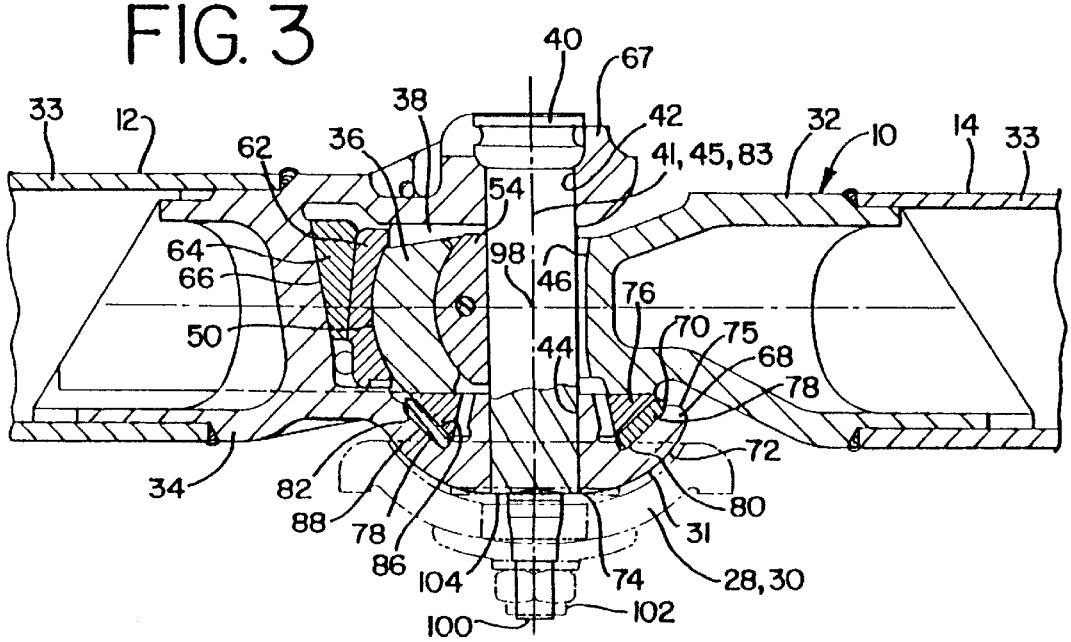
FIG. 3 is a cross-section of the articulated connector of FIG. 2, taken along line 3—3, with a mating spherical center plate of a railroad car truck shown in phantom.

One example of an articulated connector 10 is shown in detail in FIGS. 2–3 for use with railroad car trucks or bogies 30 where the bolster 28 does not have a flat center plate bearing area, but instead has a concave curved bearing surface. Trucks of this type include those known in the industry as the "Y-25 bogie". Such a concave curved bearing surface is shown in phantom at 31 in FIG. 3, and is typically in the middle of a bolster 28 of a railroad car truck 30. It should be understood that features of the present invention may be used with other types of articulated connectors.

The articulated connector 10 of FIGS. 2–3 allows relative vertical rotational and lateral angular movement between the railroad cars 12, 14 and comprises a male connecting member 32 and a female connecting member 34. The male connecting member 32 is attached to the front end of the second railroad car 14 in a conventional manner, such as by welding to the center sill 33 of the railroad car 14. The female connecting member 34 is attached to the rear end of the first railroad car 12 in a conventional manner, such as by welding to the center sill 33 of the first railroad car 12.

The male connecting member 32 has an outer end 36 received in an open ended cavity 38 of the female connecting member 34. The male and female connecting members are pivotally connected by a main pin 40 which is positioned in a pair of vertically aligned openings 42, 44 formed in the female connecting member and another opening 46 in the male connecting member vertically aligned with the openings 42, 44 in the female connecting member 34. The open-ended cavity 38 is substantially larger than the male connecting member 32 to allow the connection to articulate when negotiating vertical curves as well as horizontal curves during service operation. In the as-assembled condition shown in FIGS. 2–3, the main pin 40 has a central longitudinal axis 41 that is co-axial with the central vertical axis 45 of the vertically-aligned openings 42, 44 of the female connecting member 34.

The male connecting member 32 has an outer end spherical surface 50 along with an inner spherical surface which is formed in the vertical opening 46. Positioned within the male opening 46 is a pin bearing block 54 having a semicircular surface partly surrounding the main pin 40, and an end spherical surface abutting and complementary with the spherical inner surface of the male connecting member 32. It should be understood that these parts may be standard parts of prior art articulated connectors such as those disclosed in U.S. Pat. No. 3,716,146 (1973) to Altherr.

The outer end spherical surface 50 of the male connecting member 32 abuts a complementary spherical surface of a follower block 62 positioned within the open-ended cavity 38 of the female connecting member 34. The follower block 62 is backed by a wedge shaped shim 64 serving an automatic slack adjuster as described in U.S. Pat. No. 3,716,146 (1973) to Altherr. The wedge shaped shim 64 backs against an interior end surface 66 of the female connecting member 34 at the interior end of the open-ended cavity 38.

The female connecting member 34 has a top wall 67 and a bottom wall 68 that define the open-ended cavity 38. One vertically aligned opening 42, 44 is formed in each of the top wall 67 and bottom wall 68. The bottom wall 68 extends from the interior end surface 66 toward the open end of the cavity 38. The bottom wall 68 has an interior surface 70 and a convex-curved exterior surface 72 shaped to mate with and be received on the concave-curved surface 31 on the centerplate 33 of the bolster 28 of the railroad car truck 30. The bottom wall's exterior surface 72 has a circular edge 74 surrounding the lower vertically-aligned opening 44 and an end 75 at the open end of the female connecting member.

As shown in FIG. 3, an annular bearing 76 supports the male connecting member 32 on an inner bearing surface 86 of an annular ring seat wear liner 78. The ring seat wear liner 78 has a top 79, a bottom 81 and a central axis 83. The ring seat wear liner 78 is supported on the interior surface 70 of the bottom wall 68 of the female connecting member 34.

Figure 4:
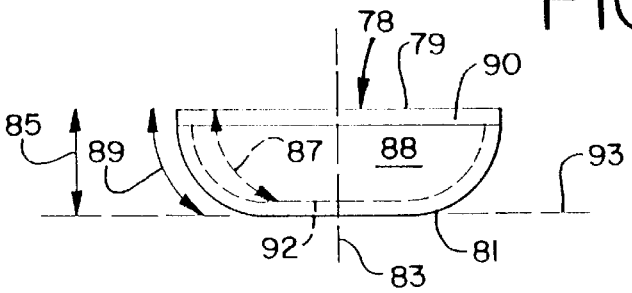
FIG. 4 is an elevation of a removable ring seat that may be used with the present invention.
Figure 5:
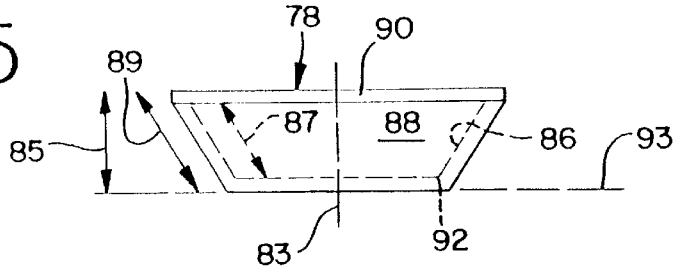
FIG. 5 is an elevation of an alternative removable ring seat that may be used with the present invention.

The ring seat wear liner 78 has a height between its top 79 and bottom 81, the height being shown in FIGS. 4 and 5 at 85, and an inner surface 86 and an outer surface 88. The inner surface 86 and outer surfaces both have widths 87, 89 between the top 79 and bottom 81. The ring seat wear liner 78 also has a thickness between the inner and outer surfaces 86, 88.

The ring seat wear liner 78 is widest near the top 79 and narrowest near the bottom 81. As shown in FIGS. 4–5, both the outer surface 88 and inner surface 86 of the ring seat wear liner 78 taper toward the central axis 83 of the ring seat wear liner 78. As shown in FIG. 4, in one embodiment of the present invention the ring seat wear liner outer surface 88 is shaped substantially as a frustum of a sphere. Alternatively, in the embodiment shown in FIG. 5, the outer surface 88 may be shaped substantially as a frustum of a cone. Both the inner and outer surfaces 86, 88 may be similarly shaped or may have different shapes; for example, with the outer surface 88 comprising the frustum of a cone and the inner surface 86 comprising the frustum of a sphere, or vice-versa. As shown in FIGS. 4–5, the ring seat wear liner 78 may have small annular angled surfaces 90, 92, near the top 79 and bottom 81 of the wear liner. Together, the outer surface 88 and the small angled surfaces 90, 92 comprise the surface of the ring seat wear liner that is beyond the inner bearing surface 86. In each embodiment, at least part of the bottom 81 of the annular ring seat wear liner 78 lies in a bottom ring seat wear liner plane 93 that is perpendicular to the central axis 83 of the annular ring seat wear liner 78. In contrast to prior art ring seat wear liners, such as that shown in FIG. 4 of U.S. Pat. No. 5,014,626 (1991), a substantial part of the surface beyond the inner bearing surface 86 lies outside of the bottom ring seat wear liner plane 93. In the illustrated embodiments, the inner and outer surfaces 86, 88 are substantially parallel to each other for a substantial part of the width 87 of the outer surface 88 of the ring seat wear liner. The thickness of the ring seat wear liner 78 between the inner and outer surfaces 86, 88 may thus be substantially uniform for a substantial part of the height 85 of the ring seat wear liner 78.

Figure 6:
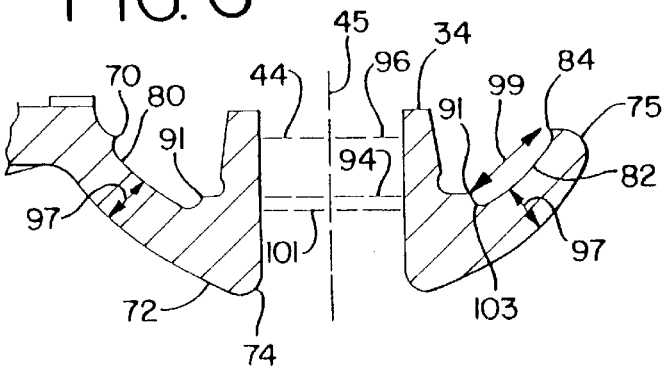
FIG. 6 is a partial cross-section of the bottom wall of one embodiment of a female connecting ember that may be used in the articulated connector of FIGS. 2–3, taken along line 3—3.
Figure 7:
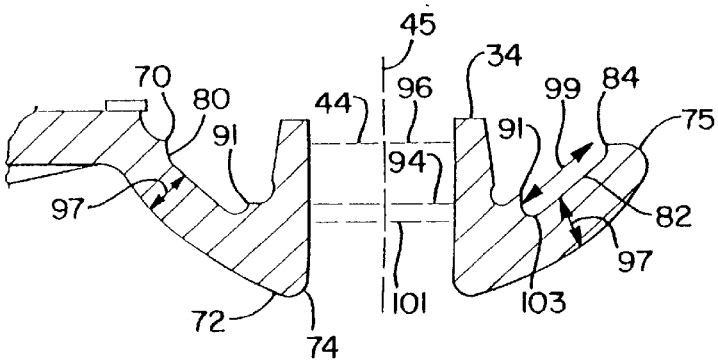
FIG. 7 is partial cross-section of the bottom wall of another embodiment of a female connecting member that may be used in the articulated connector of FIGS. 2–3, taken along line 3—3.

The outer surface 88 of the ring seat wear liner 78 is supported on the interior surface 70 of the bottom wall 68 of the female connecting member 34 in an annular lower groove 80. As shown in FIGS. 3, and 6–7, the annular lower groove 80 has a bottom surface 82 that tapers toward the vertical axis 45 of the vertically-aligned openings 42, 44 and toward the opening 44 in the bottom wall 68 of the female connecting member 34 and the central axis 41 of the main pin 40. The bottom surface 82 of the groove 80 is spaced from the convex curved exterior surface 72 of the bottom wall 68 throughout its length so that the bottom wall 68 has a sufficient thickness to provide adequate strength. The annular lower groove 80 has an inner edge 91 and an outer edge 84. As shown in FIGS. 3 and 6–7, the inner edge 91 of the annular groove 80 lies in a plane 94 perpendicular to the axis 45 of the vertically aligned openings 42, 44 and the outer edge 84 lies in a plane 96 perpendicular to the axis 45. The two planes 94, 96 are vertically spaced from each other so that the plane 96 of the outer edge 84 lines nearer to the top wall 67 of the female connecting member 34.

As shown in FIGS. 3–7, at least a portion of the annular ring seat wear liner 78 is shaped to fit within or complement the annular lower groove 80, and substantially the entire annular ring seat wear liner 78 may fit within the annular lower groove 80. The bottom surface 82 of the lower groove 80 may be shaped to taper in substantially the same direction as the outer surface 88 of the annular ring seat wear liner 78. Thus, as shown in FIG. 6, the bottom surface 82 may be shaped substantially as a frustum of a sphere to complement a ring seat wear liner 78 that has an outer surface 88 shaped substantially as a frustum of a sphere such as the ring seat wear liner 78 shown in FIG. 4. Alternatively, as shown in FIG. 7, the bottom surface 82 of the lower groove 80 may be shaped substantially as a frustum of a cone to complement a ring seat wear liner 78 that has an outer surface 88 shaped substantially as a frustum of a cone such as the ring seat wear liner 78 shown in FIG. 5. In either case, at least a substantial part of the outer surface 88 of the ring seat wear liner 78 that is in contact with the lower groove 80 lies outside of a plane perpendicular to the central axis 83 of the ring seat wear liner 78 and at the bottom 81 of the ring seat wear liner. The groove 80 has a lowest point 103 that lies in a lowest groove plane 101 that is perpendicular to the central axis 45 of the openings 42, 44, and at least a substantial part of the bottom surface 82 of the groove 80 lies outside of this lowest groove plane 101.

The thickness of the bottom wall 68 of the female connecting member 34 corresponds with the perpendicular distance, shown at 97 in FIGS. 6–7, from the bottom surface 82 of the lower groove 80 and the exterior surface 72 of the bottom wall 68 of the female connecting member. This perpendicular distance 97 may be substantially uniform for at least a substantial part of the width, shown at 99 in FIGS. 6–7, of the bottom surface 82 of the lower groove between its inner and outer edges 91, 84, and substantially uniform between the top 79 and bottom 81 of the ring seat wear liner 78. With such a uniform perpendicular distance, the thickness of the bottom wall 68 may be substantially uniform. This uniform thickness may be achieved in the case of the frusto-spherically-shaped bottom surface 82 of FIG. 6 by using the same center of curvature 98 and different radii of curvature for the exterior surface of the bottom wall and the bottom surface of the groove. For example, for Y-25 bogies, the radius of curvature for the exterior surface 72 may be about 225 cm. or about 8.9 in., and the bottom wall 68 may have a thickness 97 of about 1 in., so that the bottom surface 82 has a radius of curvature of about 7.9 in. And if the bottom surface 82 of the lower groove 80 is flat and frusto-conically-shaped while the exterior surface 72 of the bottom wall 68 is curved and frusto-spherically-shaped, the slope of the bottom surface 82 of the lower groove 80 may be set to maintain substantially constant perpendicular distances 97 between the bottom surface 82 of the groove 80 and the exterior surface 72 of the bottom wall 68.

As shown in FIG. 3, the articulated connector also includes a center pin 100 coaxial with the main pin 40 and extending beyond the bottom exterior surface 72 of the female connecting member 34 and received in an opening in the bolster 28 of the railroad car truck or bogie 30. The center pin 100 has a diameter less than the outer diameter of the main pin 40. The bottom end of the center pin is locked, such as through a locking pin 102 or other device, to fix the center pin 100 to the underside of the concave curved surface 31 of the bolster 28. The center pin 100 is integral with the main pin 40 at its upper end so that the entire articulated connector is thus locked to the concave curved surface 31 of the bolster 28. The main pin 40 and center pin 100 may be made integral by fabricating them as a single structure, or they may be made integral through a threaded connection, for example.

As shown in FIG. 3, the main pin 40 is received in the bottom opening 44 of the female connecting member 34 so that a portion 104 of the main pin 40 is at the edge 74 of the opening 44 at the exterior bottom surface 72 of the bottom wall 68. Thus, the opening 44 in the bottom wall 68 of the female connecting member has a diameter at least as great as the diameter of the main pin 40, and a portion 104 of the main pin 40 is exposed at the opening 44 in the bottom wall 68 of the female connecting member 34.

The female and male connecting members 32, 34 may be made of conventional materials in convention ways, such as by casting. The ring seat wear liner 78 may be replaceable, and made of a wear resistant material such as manganese steel.

The disassembly feature disclosed in U.S. Pat. No. 5,014,626 (1991) to Schultz may be advantageously incorporated into the articulated connector of the present invention.

With the present invention, an articulated connector 10 may be used with standard railroad car trucks or bogies having a frusto-spherically-shaped bearing surface while meeting existing requirements for the elevation from the top of the rail to the center of curvature of the convex curved bearing surface, while retaining the advantage of using a wear liner at the bearing supporting the male connecting member and while providing a bottom wall on the female connecting member of adequate strength.

While only specific embodiments of the invention have been described and shown, it is apparent that various alterations and modifications can be made therein. It is, therefore, the intention in the appended claims to cover all such modifications and alterations as may fall within the scope and spirit of the invention. Moreover, the invention is intended to include equivalent structures and structural equivalents to those described herein.

We claim:

1. An articulated connector for connecting first and second railroad cars, the articulated connector being supportable on a railroad car truck and including a male connecting member attachment to the first railroad car and a female connecting member attachment to the second railroad car, the female connecting member having a top wall and a bottom wall defining an open-ended cavity, the bottom wall having an interior surface and an exterior bottom surface, part of the male connecting member being received in the open ended cavity of the female connecting member, the articulated connector further including a main pin connecting the male and female connecting members, the main pin having a central longitudinal axis, the articulated connector further including an annular bearing contacting a part of the male connecting member, an annular ring seat wear liner having a top, a bottom, a central axis and an inner bearing surface in contact with the annular bearing, the inner bearing surface tapering toward the central axis of the annular ring seat wear liner, wherein the annular ring seat wear liner includes:

a surface beyond the inner bearing surface of the annular ring seat wear liner comprising an outer surface tapering toward the central axis of the annular ring seat wear liner, the outer surface of the annular ring seat wear liner contacting the interior surface of the bottom wall of the female connecting member, at least part of the bottom of the annular ring seat wear liner lying in a bottom ring seat wear liner plane that is perpendicular to the central axis of the annular ring seat wear liner, and wherein a substantial part of the surface of the annular ring seat wear liner beyond the inner bearing surface of the annular ring seat wear liner lies outside of said bottom ring seat wear liner plane.

2. The articulated connector of claim 1 wherein the outer surface of the annular ring seat wear liner is shaped substantially as a frustum of a cone.

3. The articulated connector of claim 1 wherein the outer surface of the annular ring seat wear liner is shaped substantially as a frustum of a sphere.

4. The articulated connector of claim 1 wherein the thickness of the annular ring seat wear liner between the inner and outer surfaces of the annular ring seat wear liner is substantially uniform for a substantial part of the width of the outer surface of the annular ring seat wear liner.

5. The articulated connector of claim 1 wherein substantially all of the surface beyond the inner bearing surface of the annular ring seat wear liner lies outside of the bottom ring seat wear liner plane.

6. An articulated connector for connecting adjacent first and second railroad cars, the articulated connector being supportable on a railroad car truck and including a male connecting member attachment to the first railroad car and a female connecting member attachment to the second railroad car, the male connecting member having an outer end, the female connecting member having a top wall and a bottom wall defining an open-ended cavity receiving the outer end of the male connecting member, the bottom wall of the female connecting member having an interior surface and an exterior bottom surface, the female connecting member having an opening in the bottom wall of the female connecting member the articulated connector further including an annular bearing contacting a part of the male connecting member, an annular ring seat wear liner having an inner support surface contacting the annular bearing, the annular ring seat wear liner having a top, a bottom, a height between the top and bottom, and a central axis, the inner support surface of the annular ring seat wear liner tapering toward the central axis, wherein:

the female connecting member includes an annular lower groove in the interior surface of the bottom wall of the female connecting member to receive the annular ring seat wear liner, the annular lower groove having a bottom surface tapering toward the opening in the bottom wall and being spaced from the exterior bottom surface of the bottom wall of the female connecting member; and wherein the annular ring seat wear liner has an outer surface shaped to complement the shape of the annular lower groove of the female connecting member, the outer surface of the annular ring seat wear liner being tapered in substantially the same direction as the inner surface of the annular ring seat wear liner for a substantial part of the height of the annular ring seat wear liner and in substantially the same direction as the bottom surface of the annular lower groove; and wherein the perpendicular distance from the bottom surface of the lower groove in the interior surface of the bottom wall of the female connecting member to the exterior surface of the bottom wall of the female connecting member is substantially uniform between the top and bottom of the annular ring seat wear liner.

7. The articulated connector of claim 6 wherein the bottom surface of the lower annular groove is shaped substantially as a frustum of a cone.

8. The articulated connector of claim 6 wherein the bottom surface of the lower annular groove is shaped substantially as a frustum of a sphere.

9. The articulated connector of claim 6 wherein the main pin and center pin are integral.

10. The articulated connector of claim 6 wherein the main pin has an outer diameter and wherein the opening, in the bottom wall of the female connecting member has a diameter at least as great as the outer diameter of the main pin.

11. The articulated connector of claim 10 wherein a portion of the main pin is exposed at the opening in the bottom wall of the female connecting member.

12. An articulated connector for connecting adjacent first and second railroad cars, the articulated connector being supportable on a railroad car truck and including a male connecting member attachment to the first railroad car and a female connecting member attachment to the second railroad car, the male connecting member having an outer end, the female connecting member having top and bottom walls defining an open-ended cavity receiving the outer end of the male connecting member, the bottom wall of the female connecting member having an interior surface and an exterior bottom surface adapted to mate with and be received on a surface on the railroad car truck, the articulated connector including an annular bearing contacting a part of the male connecting member, and an annular ring, seat wear liner contacting the annular bearing, the annular ring seat wear liner having a top, a bottom, a height between the top and bottom, a central axis, an inner surface and an outer surface, wherein:

the interior surface of the bottom wall of the female connecting member has a lower groove with a bottom surface in contact with the outer surface of the annular ring seat wear liner and tapering toward the central axis of the annular ring seat wear liner; and the outer surface of the annular ring seat wear liner tapers toward the central axis of the annular ring seat wear liner, wherein at least part of the bottom of the annular ring seat wear liner lies in a bottom ring seat wear liner plane that is perpendicular to the axis of the annular ring seat wear liner and wherein a substantial part of the outer surface of the annular ring seat wear liner in contact with the lower groove lies outside of said bottom ring seat wear liner plane.

13. The articulated connector of claim 12 wherein the annular ring seat wear liner has a substantially uniform thickness between the inner and outer surfaces.

14. The articulated connector of claim 12 wherein the outer surface of the annular ring seat wear liner is shaped substantially as a frustum of a cone.

15. The articulated connector of claim 12 wherein the outer surface of the annular ring seat wear liner is shaped substantially as a frustum of a sphere.

16. The articulated connector of claim 12 wherein the perpendicular distance from the bottom surface of the lower groove and the exterior surface of the bottom wall of the female connecting member is substantially uniform for at least a substantial part of the width of the bottom surface of the lower groove.

17. The articulated connector of claim 12 wherein the bottom surface of the lower annular groove is shaped substantially as a frustum of a cone and wherein the annular ring seat wear liner has an outer surface shaped substantially as a frustum of a cone to complement the shape of the inner annular groove.

18. The articulated connector of claim 12 wherein the bottom surface of the lower annular groove is shaped substantially as a frustum of a sphere and wherein the annular ring seat wear liner has an inner surface and an outer surface shaped substantially as a frustum of a sphere to complement the shape of the lower annular groove.

19. The articulated connector of claim 12 wherein substantially all of the outer surface of the annular ring seat wear liner lies outside of the bottom ring seat wear liner plane.

20. An articulated connector for connecting adjacent first and second railroad cars, the articulated connector being supportable on a railroad car truck and including a male connecting member attachment to the first railroad car and a female connecting member for attachment to the second railroad car, the male connecting member having an outer end, the female connecting member having top and bottom walls defining an open-ended cavity receiving the outer end of the male connecting member, an annular bearing contacting a part of the male connecting member, an annular ring seat wear liner having a top, a bottom, a central axis and an inner bearing surface contacting the annular bearing, the inner bearing surface tapering toward the central axis, wherein the annular ring seat wear liner includes:

a surface beyond the inner bearing surface of the annular ring seat wear liner comprising an outer surface tapering toward the central axis of the annular ring seat wear liner, at least part of the bottom of the annular ring seat wear liner lying in a bottom ring seat wear liner plane perpendicular to the central axis of the annular ring seat wear liner, and wherein a substantial part of the surface of the annular ring seat wear liner beyond the inner bearing surface lies outside of said bottom ring seat wear liner plane;

wherein the annular ring seat wear liner comprises a metal member.

21. The articulated connector of claim 20 wherein the substantially all of the surface beyond the inner bearing surface of the annular ring seat wear liner lies outside of the bottom ring seat wear liner plane.

* * * * *